US007662531B2

(12) United States Patent
Gerroir et al.

(10) Patent No.: US 7,662,531 B2
(45) Date of Patent: Feb. 16, 2010

(54) TONER HAVING BUMPY SURFACE MORPHOLOGY

(75) Inventors: Paul J. Gerroir, Oakville (CA); Daryl W. Vanbesien, Burlington (CA); Vladislav Skorokhod, Mississauga (CA); Maria N.V. McDougall, Oakville (CA); Eric Strohm, Oakville (CA); Edward G. Zwartz, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 565 days.

(21) Appl. No.: 11/228,300

(22) Filed: Sep. 19, 2005

(65) Prior Publication Data

US 2007/0065745 A1 Mar. 22, 2007

(51) Int. Cl.
*G03G 9/093* (2006.01)

(52) U.S. Cl. ..... 430/110.2; 430/110.3; 430/137.14; 430/137.12

(58) Field of Classification Search ..... 430/110.3, 430/110.2, 137.12, 137.14
See application file for complete search history.

(56) References Cited

U.S. PATENT DOCUMENTS

| | | | | |
|---|---|---|---|---|
| 3,847,604 | A | | 11/1974 | Hagenbach et al. |
| 3,944,493 | A | | 3/1976 | Jadwin et al. |
| 4,007,293 | A | | 2/1977 | Mincer et al. |
| 4,079,014 | A | | 3/1978 | Burness et al. |
| 4,394,430 | A | | 7/1983 | Jadwin et al. |
| 4,560,635 | A | | 12/1985 | Hoffend et al. |
| 4,794,065 | A | * | 12/1988 | Hedvall et al. ..... 430/110.2 |
| 4,935,326 | A | | 6/1990 | Creatura et al. |
| 4,937,166 | A | | 6/1990 | Creatura et al. |
| 5,175,071 | A | * | 12/1992 | Mychajlowskij et al. .... 430/138 |
| 5,208,630 | A | * | 5/1993 | Goodbrand et al. ..... 399/15 |
| 5,236,629 | A | | 8/1993 | Mahabadi et al. |
| 5,278,020 | A | | 1/1994 | Grushkin et al. |
| 5,290,654 | A | | 3/1994 | Sacripante et al. |
| 5,308,734 | A | | 5/1994 | Sacripante et al. |
| 5,330,874 | A | | 7/1994 | Mahabadi et al. |
| 5,344,738 | A | | 9/1994 | Kmiecik-Lawrynowicz et al. |
| 5,346,797 | A | | 9/1994 | Kmiecik-Lawrynowicz et al. |
| 5,348,832 | A | | 9/1994 | Sacripante et al. |

(Continued)

FOREIGN PATENT DOCUMENTS

JP 60-101547 * 6/1985

(Continued)

OTHER PUBLICATIONS

English translation of JP 05-034965 published Feb. 1993.*

(Continued)

*Primary Examiner*—Mark F Huff
*Assistant Examiner*—Peter L Vajda
(74) *Attorney, Agent, or Firm*—Oliff & Berridge, PLC

(57) ABSTRACT

The toner described herein contains toner particles containing polymer, colorant and cross-linked polymer. The cross-linked polymer is incorporated at least in the shell of the toner particles. Incorporating cross-linked polymer in the shell of the toner particles provide bumps in the surface of the toner particles. These bumps can behave as spacers. Such toner can be formed by aggregating at least polymer particles and colorant particles to form core particles; aggregating at least cross-linked polymer particles to the surface of the core particles; and coalescing the resulting particles to form toner particles.

18 Claims, 9 Drawing Sheets

U.S. PATENT DOCUMENTS 5,364,729 A 11/1994 Kmiecik-Lawrynowicz et al.
5,366,841 A 11/1994 Patel et al.
5,370,963 A 12/1994 Patel et al.
5,403,693 A 4/1995 Patel et al.
5,405,728 A 4/1995 Hopper et al.
5,418,108 A 5/1995 Kmiecik-Lawrynowicz et al.
5,422,218 A * 6/1995 Tong ..... 430/108.3
5,496,676 A 3/1996 Croucher et al.
5,501,935 A 3/1996 Patel et al.
5,527,658 A 6/1996 Hopper et al.
5,541,031 A * 7/1996 Yamashita et al. ..... 430/129
5,585,215 A 12/1996 Ong et al.
5,650,255 A 7/1997 Ng et al.
5,650,256 A 7/1997 Veregin et al.
5,716,752 A 2/1998 Ott et al.
5,744,520 A 4/1998 Kmiecik-Lawrynowicz et al.
5,747,215 A 5/1998 Ong et al.
5,763,132 A 6/1998 Ott et al.
5,763,133 A 6/1998 Ong et al.
5,766,818 A 6/1998 Smith et al.
5,804,349 A 9/1998 Ong et al.
5,827,633 A 10/1998 Ong et al.
5,840,462 A 11/1998 Foucher et al.
5,853,944 A 12/1998 Foucher et al.
5,869,215 A 2/1999 Ong et al.
6,180,307 B1 1/2001 Kmiecik-Lawrynowicz
6,767,684 B1 7/2004 Patel et al.
2002/0187415 A1 * 12/2002 Jiang et al. ..... 430/137.14
2003/0073024 A1 * 4/2003 Vanbesien et al. ..... 430/137.14
2004/0202952 A1 * 10/2004 Albright et al. ..... 430/137.14
2005/0031979 A1 2/2005 McStravick et al.
2005/0191575 A1 * 9/2005 Sugiura et al. ..... 430/110.3

FOREIGN PATENT DOCUMENTS

JP 05-034965 * 2/1993

OTHER PUBLICATIONS

English translation of abstract of JP 60-101547 published Jun. 1985.*

* cited by examiner

TONER HAVING BUMPY SURFACE MORPHOLOGY

TECHNICAL FIELD

The disclosure relates to toner and to methods for forming toner, particularly toner with a bumpy morphology, that may be used in xerographic processes and devices.

BACKGROUND

The electrostatographic process, and particularly the xerographic process, is known. This process involves the formation of an electrostatic latent image on a photoreceptor, followed by development of the image with a developer, and subsequent transfer of the image to a suitable substrate. In xerography, the surface of an electrophotographic plate, drum, belt or the like (imaging member or photoreceptor) containing a photoconductive insulating layer on a conductive layer is first uniformly electrostatically charged. The imaging member is then exposed to a pattern of activating electromagnetic radiation, such as light. The radiation selectively dissipates the charge on the illuminated areas of the photoconductive insulating layer while leaving behind an electrostatic latent image on the non-illuminated areas. This electrostatic latent image may then be developed to form a visible image by depositing finely divided marking particles on the surface of the photoconductive insulating layer. The resulting visible image may then be transferred from the imaging member directly or indirectly (such as by a transfer or other member) to a print substrate, such as transparency or-paper. The imaging process may be repeated many times with reusable imaging members.

U.S. Pat. No. 6,767,684 to Patel et al. describes an emulsion aggregation process for forming toner that combines both a latex containing a cross-linked resin and a latex containing a resin free of cross-linking. The process comprises, inter alia, mixing a colorant dispersion comprising an acicular magnetite dispersion and a colorant with a latex containing a cross-linked resin, a latex containing a resin free of cross-linking, a wax dispersion, and a coagulant; heating the resulting mixture below about the glass transition temperature (Tg) of the latex resin to form toner sized aggregates; adding to the formed toner aggregates further resin latex; adding a base to adjust the pH; and heating the resulting aggregate suspension to permit fusion or coalescence of the toner aggregates and to obtain smooth particles. In each of the Examples, the latex added after the formation of toner sized aggregates was non-cross-linked latex.

U.S. Pat. No. 5,763,132 to Ott et al. describes a process for decreasing toner adhesion and decreasing toner cohesion, which comprises adding a hard spacer component of a polymer of polymethyl methacrylate (PMMA), a metal, a metal oxide, a metal carbide, or a metal nitride, to the surface of a toner comprised of resin, wax, compatibilizer, and colorant excluding black, and wherein toner surface additives are blended with said toner, and wherein said component is permanently attached to the toner surface by the injection of said component in a fluid bed milling device during the size reduction process of said toner contained in said device, and where the power imparted to the toner to obtain said attachment is from equal to, or about above 5 watts per gram of toner. See the Abstract and column 1, lines 9-28.

U.S. Pat. No. 5,716,752 to Ott et al. describes a process for decreasing toner adhesion and decreasing toner cohesion, which comprises adding a component of magnetite, a metal, a metal oxide, a metal carbide, or a metal nitride to the surface of a toner comprised of resin, wax, and colorant, and wherein toner surface additives are blended with said toner, and wherein said component is permanently attached to the toner surface by the injection of said component in a fluid bed milling device during the size reduction process of said toner contained in said device, and where the power imparted to the toner to obtain said attachment is from equal to, or about above 5 watts per gram of toner. See the Abstract.

Having spacer-particles enables toner and developer including such toner to exhibit reduced toner cohesion, improved flow and transfer efficiency stability and hence excellent development and transfer stability during copying/printing in xerographic imaging processes, and minimized development falloff, for example including maintaining DMA (developed mass per area on a photoreceptor), TMA (transferred mass per area from a photoreceptor), and/or triboelectric charging characteristics for an extended number of imaging cycles.

SUMMARY

It is desired to have good toner flow and low toner adhesion to surfaces in a developer subsystem to provide good toner transfer from the donor roll onto the photoreceptor, and from the photoreceptor onto paper. The use of nearly-spherical emulsion aggregation toners allows for the use of larger external additive as spacers to assist in these developer issues, as described in, for example, U.S. Published Application No. 2005-0031979 A1 published Feb. 10, 2005, which is herein incorporated by reference in its entirety. However, because of their size, external spacers do not always adhere well to the toner surface. In addition, external spacers typically require very spherical toner particles for good surface dispersion because once less-spherical shape is used, the external spacers tend to accumulate at low-curvature regions. Furthermore, like smaller additives, they can become impacted in the toner whereby they no longer function as spacers. Additionally, external spacers can be expensive.

The present disclosure describes a toner wherein a cross-linked latex resin or gel is incorporated into the toner particles, such as during emulsion aggregation particle formation. The cross-linked resin or gel may have a crosslinking density from about 0.3 percent to about 50 percent, such as from about 0.4 percent to about 20 percent. The cross-linked resin or gel may be added evenly to the surface of the toner aggregates in the form of a shell.

Upon coalescence of the toner aggregates, the cross-linked resin or gel in the shell results in a "bumpy" morphology. These bumps or protuberances may be dispersed randomly on the toner particle surface and are typically spherical in-nature. The diameter of such features can vary from about 50 to about 300 nanometers, such as from about 100 to about 200 nanometers, while their height may have a range of from about 25 to about 150 nanometers, such as from about 50 to about 100 nanometers. This bumpy morphology allows the cross-linked resin to behave like a spacer on the surface of the toner, which can improve development, including better toner flow, reduced toner adhesion, and improved developability and transfer efficiency. This opens a new path to produce chemical toner with superior development, and eliminates the use of more expensive external surface additives used as spacers. In particular, by forming toner according to the present disclosure, toner can be obtained with a transfer efficiency of greater than 95% without including external surface additives used as spacers.

Thus, in embodiments, the disclosure is directed to toner comprising toner particles having a core and a shell. These toner particles comprise polymer, colorant and cross-linked polymer. The cross-linked polymer is incorporated at least in the shell of the toner particles. Incorporating cross-linked polymer in the shell of the toner particles provides bumps in the surface of the toner particles. These bumps can behave as spacers. This disclosure is also directed to developer containing such toner.

In other embodiments, the disclosure is directed to a method for forming toner. The method comprises: aggregating at least polymer particles and colorant particles to form core particles; aggregating at least cross-linked polymer particles to the surface of the core particles; and coalescing the resulting particles to form toner particles. By this process cross-linked polymer particles are incorporated into the shell of the toner particles, providing bumps in their surface.

By having cross-linked latex particles embedded in the toner surface, the problems associated with poor adhesion and impaction of toner spacer additives to the surface are not a concern. In addition, due to the nature of the process of adding the cross-linked resin during aggregate shell formation, the cross-linked resin generally forms bumps fairly uniformity along the surface of the toner, regardless of the shape of the toner. This is beneficial because the alternative use of external silica additives on rough or potato shaped toner generally results in the accumulation of the external additives at low-curvature regions, thus reducing their effectiveness.

BRIEF DESCRIPTION OF THE DRAWINGS

Various exemplary embodiments of the disclosure will be described in detail, with reference to the following figures.

EMBODIMENTS

Figure 1A:
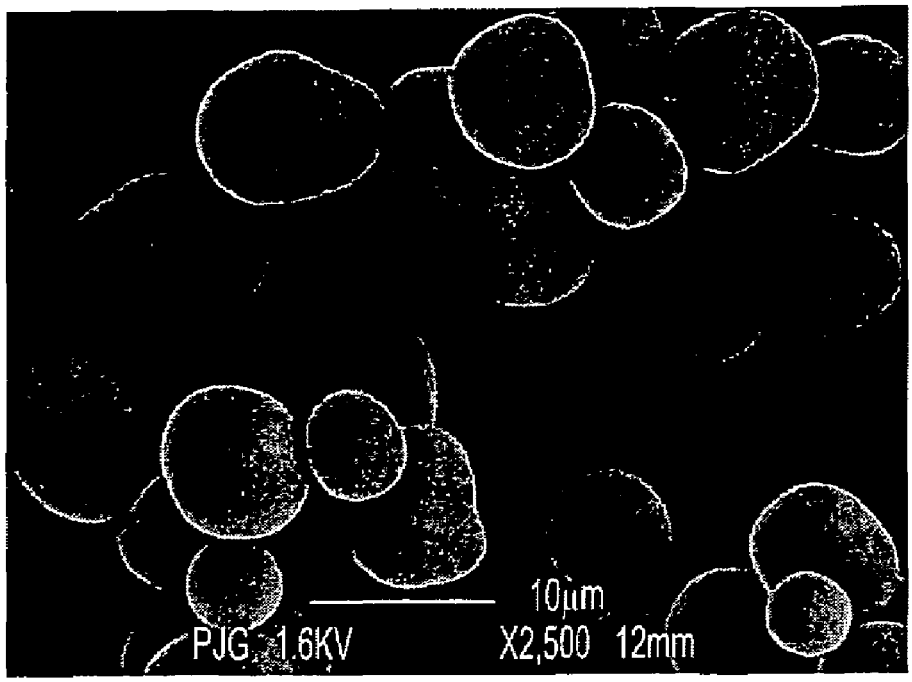
FIGS. 1A and 1B are scanning electron microscope images illustrating toner with a smooth surface.

In embodiments, the disclosure is directed to toner comprising toner particles having a core and a shell. These toner particles comprise polymer, colorant and cross-linked polymer. The cross-linked polymer is incorporated at least in the shell of the toner particles.

The polymer and/or cross-linked polymer may be any polymer suitable for the formation of toner. Illustrative examples of suitable polymers include, but are not limited to, polyamides, polyolefins, styrene acrylates, styrene methacrylates, styrene butadienes, polyesters, especially reactive extruded polyesters, crosslinked styrene polymers, epoxies, polyurethanes, vinyl resins, including homopolymers or copolymers of two or more vinyl monomers, and polymeric esterification products of a dicarboxylic acid and a diol comprising a diphenol. Vinyl monomers may include, for example, styrene, p-chlorostyrene, unsaturated mono-olefins such as ethylene, propylene, butylene, isobutylene and the like; saturated mono-olefins such as vinyl acetate, vinyl propionate, and vinyl butyrate; vinyl esters such as esters of monocarboxylic acids including, for example, methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide; mixtures thereof; and the like; and styrene/butadiene copolymers with a styrene content of from about 70 to about 95 weight percent. As the cross-linked polymer, cross-linked polymers, copolymers, homopolymers of the aforementioned styrene polymers may be selected.

In an embodiment, the polymer and/or the cross-linked polymer comprise a styrene acrylic copolymer. As used herein, the term "styrene acrylic copolymer" refers to a copolymer containing styrene monomers and acrylic monomers. In the cross-linked polymer, the styrene acrylic copolymer is, of course, a cross-linked styrene acrylic copolymer.

As used herein, the term "styrene monomer" refers to styrene per se, as well as styrene containing one or more substitutions, such as 3-chlorostyrene, 2,5-dichlorostyrene, 4-bromostyrene, 4-tert-butylstyrene, 4-methoxystyrene and the like.

As used herein, the term "acrylic monomer" refers to acrylic acid, methacrylic acid, and esters of acrylic acid and methacrylic acid. Acrylic monomers include, but are not limited to, butyl acrylate, butyl methacrylate, propyl acrylate, propyl methacrylate, ethyl acrylate, ethyl methacrylate, methyl acrylate and methyl methacrylate. In embodiments, the acrylic monomer is n-butyl acrylate.

In embodiments, styrene monomer is used in the copolymer in amounts greater than about 15 weight percent. In embodiments, the amount of styrene monomer is from about 15 to about 85 weight percent, such as from about 60 to about 85 weight percent, based on the total weight of the polymer particles.

In embodiments, acrylic monomer is used in the copolymer in amounts of greater than about 15 weight percent. In embodiments, the amount of acrylic monomer is from about 15 to about 85 weight percent, such as from about 15 to about 40 weight percent, based on the total weight of the polymer particles.

In an embodiment, the monomers forming the copolymer comprise styrene, n-butyl acrylate and 2-carboxyethyl acrylate (β-CEA). In embodiments of the disclosure, the copolymer contains from about 60 to about 80 weight percent styrene, about 15 to about 35 weight percent n-butyl acrylate and about 1 to about 5 weight percent β-CEA.

To form the cross-linked polymer, any cross-linker may be used. As used herein, the term "cross-linker" refers, for example, to a di-functional material that can be used to cross-link a polymer. Cross-linkers that may be used, include, but are not limited to, ethylene glycol diacrylate, diethylene glycol dimethacrylate, triethylene glycol dimethacrylate, tetraethylene glycol dimethacrylate, 1,3-butylene glycol dimethacrylate, trimethylolpropane triacrylate, trimethylolpropane trimethacrylate, 1,4-butanediol diacrylate, neopentyl glycol diacrylate, 1,6-hexanediol diacrylate, pentaerythritol diacrylate, pentaerythritol triacrylate, pentaerythritol tetraacrylate, pentaerythritol dimethacrylate, pentaerythritol trimethacrylate, pentaerythritol tetramethacrylate, glycelol dimethacrylate, glycelol diacrylate, glycelol acryloxy dimethacrylate, 1,1,1-trishydroxymethylethane diacrylate, 1,1,1-trishydroxymethylethane triacrylate, 1,1,1-trishydroxymethylethane dimethacrylate, 1,1,1-trishydroxymethylethane triacrylate, 1,1,1-trishydroxymethylpropane diacrylate, 1,1,1-trishydroxymethylpropane triacrylate, 1,1,1-trishydroxymethylpropane dimethacrylate, 1,1,1-trishydroxymethylpropane trimethacrylate, triallyl cyanurate, triallyl isocyanurate, triallyl trimellitate, diallyl terephthalate, diallyl phthalate, divinylbenzene, diisopropenylbenzene or a mixture thereof. In embodiments, the cross-linker is divinyl benzene.

The polymer and/or cross-linked polymer may be formed by emulsion polymerization. To form the cross-linked polymer, cross-linker may be present in the monomer emulsion in an amount of from about 0.4 percent by weight to about 50 percent by weight based on a total amount of monomer used to form the cross-linked polymer. However, amounts of more than 50 percent by weight can also be used. In embodiments, the cross-linker is present in the monomer emulsion in an amount of about 0.5 to about 5 percent by weight based on a total amount of monomer used to form the cross-linked polymer.

Toner generally also comprises colorant. The colorant may be contained in the core of the toner particles described herein. Colorants include pigments, dyes, and mixtures of pigments with dyes, and the like. The colorant is generally present in the toner in an effective amount of, for example, from about 1 to about 15 weight percent by weight of toner, and in embodiments in an amount of from about 3 to about 10 weight percent by weight of the toner.

Illustrative examples of colorants, such as pigments, that may be used in the processes of the present disclosure include, but are not limited to, carbon black, such as REGAL 330.R™; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. Colored pigments or dyes, including cyan, magenta, yellow, red, green, brown, blue and/or mixtures thereof, may also be used. Generally, cyan, magenta, or yellow pigments or dyes, or mixtures thereof, are used. The pigment or pigments are generally used as water based pigment dispersions.

Specific examples of pigments include, but are not limited to, SUNSPERSE 6000™, FLEXIVERSE™ and AQUATONE™ water based pigment dispersions from SUN Chemicals, HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Examples of magentas include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows include diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as pigments in the present disclosure.

The toner particles of the present disclosure may also comprise a wax. In particular, waxes with a molecular weight of from about 500 to about 10,000, such as polyethylene, polypropylene, and paraffin waxes, may be included in the toner compositions as fuser roll release agents. Other conventional toner additives may be included in the toner particles without limitation, for example, charge enhancing additives, etc.

While any desired toner particle size may be used, in an embodiment, the finished toner particles have an average particle size (volume median diameter) of from about 5.0 to about 9.0 microns, in embodiments of from about 6.0 to about 8.0 microns, as measured by the known Layson cell technique. The toner may also exhibit a narrow particle size distribution, e.g., a geometric standard deviation (GSD) of approximately 1.30 or less, in embodiments less than 1.25 by number for conventional toner and less than 1.25 by number and volume for chemical toner.

In embodiments, toner is formed by: aggregating at least polymer particles and colorant particles to form core particles; aggregating at least cross-linked polymer particles to the surface of the core particles; and coalescing the resulting particles to form toner particles. By this process, cross-linked polymer particles are incorporated into the shell of the toner particles, providing bumps in their surface.

In an embodiment, the polymer particles and/or the cross-linked polymer particles are latex particles formed by emulsion polymerization. Techniques for forming latex particles by emulsion polymerization are known in the art. In particular, emulsion polymerization methods are described in, for example, U.S. Pat. Nos. 5,370,963, 5,418,108, 5,290,654, 5,278,020, 5,308,734, 5,344,738, 5,403,693, 5,364,729, 5,346,797, 5,348,832, 5,405,728, 5,366,841, 5,496,676, 5,527,658, 5,585,215, 5,650,255, 5,650,256, 5,501,935, 5,723,253, 5,744,520, 5,763,133, 5,766,818, 5,747,215, 5,827,633, 5,853,944, 5,804,349, 5,840,462, 5,869,215, and 6,180,307, which are each incorporated herein in their entirety by reference hereto.

To form toner from the polymer particles, the process may comprise blending a colorant, such as a colorant dispersion, for example containing a pigment, such as carbon black, phthalocyanine, quinacridone or RHODAMIE B™ type, with polymer particles and a flocculate and optionally with a wax and/or charge additives; heating the resulting flocculate mixture at a temperature below the $T_g$ of the polymer, in embodiments from about 25° C. to about 1° C. below the $T_g$ of the polymer, for an effective length of time of, for example, 0.5 hour to about 2 hours, to form aggregates; blending the aggregates with cross-linked polymer particles; heating the resulting mixture to aggregate the cross-linked polymer particles on the surface of the aggregates; adjusting the pH of the mixture from about 6.0 to about 7.0 using a base; subsequently heating the aggregate suspension at a temperature at or above the $T_g$ of the polymer, for example from about 60° C. to about 120° C.; lowering the pH of the mixture to about 3.0 to about 6.0 using an acid, to effect coalescence or fusion, thereby providing toner particles; and isolating the toner product, such as by filtration, thereafter optionally washing and drying the toner particles, such as in an oven, fluid bed dryer, freeze dryer, or spray dryer.

The polymer particles are generally present in the toner compositions in various effective amounts, such as from about 75 weight percent to about 98 weight percent by weight of the toner. However, other effective amounts of polymer particles may be selected in embodiments.

Flocculants may be used in effective amounts of, for example, from about 0.01 percent to about 10 percent by weight of the toner. Flocculants that may be used include, but are not limited to, polyaluminum chloride (PAC), polyaluminum sulfo silicate, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™ available from Alkaril Chemical Company, SANIZOL™ (benzalkonium chloride), available from Kao Chemicals, and the like.

Charge additives may also be used in suitable effective amounts of, for example, from 0.1 to 5 weight percent by weight of the toner. Suitable charge additives include, but are not limited to, alkyl pyridinium halides, bisulfates, the charge control additives of U.S. Pat. Nos. 3,944,493; 4,007,293; 4,079,014; 4,394,430 and 4,560,635, which illustrate a toner with a distearyl dimethyl ammonium methyl sulfate charge additive, the entire disclosures of which are hereby incorporated by reference, negative charge enhancing additives like aluminum complexes, and the like.

The toner particles are optionally blended with external additives following formation. Any suitable surface additives may be used. External additives include one or more of $SiO_2$, metal oxides such as, for example, $TiO_2$ and aluminum oxide, and a lubricating agent such as, for example, a metal salt of a fatty acid (e.g., zinc stearate (ZnSt), calcium stearate) or long chain alcohols such as UNILIN 700. In general, silica may be applied to the toner surface for toner flow, tribo enhancement, admix control, improved development and/or transfer stability and/or higher toner blocking temperature. $TiO_2$ may be applied for improved relative humidity (RH) stability, tribo control and/or improved development and/or transfer stability. Zinc stearate may also used as an external additive for the toners of the disclosure, the zinc stearate providing, for example, lubricating properties. Zinc stearate may provide developer conductivity and/or tribo enhancement, both due to its lubricating nature. In addition, zinc stearate may enable higher toner charge and/or charge stability by increasing the number of contacts between toner and carrier particles. Calcium stearate and magnesium stearate may provide similar functions. In embodiments, the zinc stearate is a commercially available zinc stearate known as Zinc Stearate L, obtained from Ferro Corporation. The external surface additives can be used with or without a coating.

In embodiments, the toners contain from, for example, about 0.5 to about 5 weight percent titania (size of from about 10 nm to about 50 nm, such as about 40 nm), about 0.5 to about 5 weight percent silica (size of from about 10 nm to about 50 nm, such as about 40 nm), about 0.5 to about 5 weight percent sol-gel silica and about 0.1 to about 4 weight percent zinc stearate.

The toner compositions can optionally be formulated into a developer composition by mixing the toner particles with carrier particles. Illustrative examples of carrier particles that can be selected for mixing with the toner composition include those particles that are capable of triboelectrically obtaining a charge of opposite polarity to that of the toner particles. Accordingly, in one embodiment, the carrier particles may be selected so as to be of a positive polarity in order that the toner particles that are negatively charged will adhere to and surround the carrier particles. Illustrative examples of such carrier particles include granular zircon, granular silicon, glass, steel, nickel, iron ferrites, silicon dioxide, and the like. Additionally, there can be selected as carrier particles nickel berry carriers as disclosed in U.S. Pat. No. 3,847,604, the entire disclosure of which is totally incorporated herein by reference, comprised of nodular carrier beads of nickel, characterized by surfaces of reoccurring recesses and protrusions thereby providing particles with a relatively large external area. Other carriers are disclosed in U.S. Pat. Nos. 4,937,166 and 4,935,326, the disclosures of which are totally incorporated herein by reference.

The selected carrier particles can be used with or without a coating, the coating generally being comprised of fluoropolymers, such as polyvinylidene fluoride resins, terpolymers of styrene, methyl methacrylate, and a silane, such as triethoxy silane, tetrafluoroethylenes, other known coatings and the like.

In embodiments, the carrier is a steel core, for example of about 50 to about 75 μm in size, coated with about 0.5% to about 5% by weight, such as about 1% by weight, of a conductive polymer mixture comprised of methylacrylate and carbon black using the process described in U.S. Pat. No. 5,236,629 and U.S. Pat. No. 5,330,874.

The carrier particles can be mixed with the toner particles in various suitable combinations. The concentrations are usually about 1% to about 20% by weight of toner and about 80% to about 99% by weight of carrier. However, one skilled in the art will recognize that different toner and carrier percentages may be used to achieve a developer composition with desired characteristics.

In embodiments, the present disclosure is directed to a xerographic device comprising the toner or developer described herein.

The toners can be used in known electrostatographic imaging methods. Thus for example, the toners or developers can be charged, e.g., triboelectrically, and applied to an oppositely charged latent image on an imaging member such as a photoreceptor or ionographic receiver. The resultant toner image can then be transferred, either directly or via an intermediate transport member, to an image receiving substrate such as paper or a transparency sheet. The toner image can then be fused to the image receiving substrate by application of heat and/or pressure, for example with a heated fuser roll.

EXAMPLES

The following examples illustrate specific embodiments of the present disclosure. The appropriate reagents, component ratio/concentrations may be adjusted as necessary to achieve specific product characteristics. All parts and percentages are by weight unless otherwise indicated.

Preparation of Latex A

A latex emulsion comprised of polymer particles generated from the emulsion polymerization of styrene, n-butyl acrylate and beta-CEA is prepared as follows. A surfactant solution consisting of 605 grams Dowfax 2A1 (anionic emulsifier) and 387 kg de-ionized water is prepared by mixing for 10 minutes in a stainless steel holding tank. The holding tank is then purged with nitrogen for 5 minutes before transferring into the reactor. The reactor is then continuously purged with nitrogen while being stirred at 100 RPM. The reactor is then heated up at a controlled rate to 80° C., and held there. Separately 6.1 kg of ammonium persulfate initiator is dissolved in 30.2 kg of de-ionized water.

Separately the monomer emulsion is prepared in the following manner. 311.4 kg of styrene, 95.6 kg of butyl acrylate and 12.21 kg of P-CEA, 2.88 kg of 1-dodecanethiol, 1.42 kg of 1,10-decanediol diacrylate (ADOD), 8.04 kg of Dowfax 2A1 (anionic surfactant), and 193 kg of deionized water are mixed to form an emulsion. 1% of the above emulsion is then slowly fed into the reactor containing the aqueous surfactant phase at 80° C. to form the "seeds" while being purged with nitrogen. The initiator solution is then slowly charged into the reactor and, after 10 minutes, the rest of the emulsion is continuously fed in using a metering pump at a rate of 0.5%/min. Once all the monomer emulsion is charged into the main reactor, the temperature is held at 80° C. for an additional 2 hours to complete the reaction. Full cooling is then applied and the reactor temperature is reduced to 35° C. The product is collected into a holding tank. After drying the latex, the molecular properties are Mw=35,419 Mn=11,354 and the onset Tg was 51.0° C.

Preparation of Cross-Linked Latex B

A cross-linked latex emulsion comprised of polymer particles generated from the emulsion polymerization of styrene, n-butyl acrylate, divinylbenzene, and beta-CEA is prepared as follows. A surfactant solution consisting of 0.8 grains Dowfax 2A1 (anionic emulsifier) and 514 grams de-ionized water is prepared by mixing for 10 minutes in a stainless steel holding tank. The holding tank is then purged with nitrogen for 5 minutes before transferring into the reactor. The reactor is then continuously purged with nitrogen while being stirred at 300 RPM. The reactor is then heated up to 76° C. at a controlled rate, and held there. Separately 8.1 grams of ammonium persulfate initiator is dissolved in 45 grams of de-ionized water.

Separately the monomer emulsion is prepared in the following manner. 413.1 grams of styrene, 126.9 grams of butyl acrylate, 5.4 grams of divinyl benzene (55% tech), 16.2 grams of β-CEA, 8.316 grams of 1-dodecanethiol, 1.89 grams of ADOD, 10.69 grams of Dowfax 2A1 (anionic surfactant), and 257 grams of deionized water are mixed to form an emulsion. 1% of the above emulsion is then slowly fed into the reactor containing the aqueous surfactant phase at 76° C. to form the "seeds" while being purged with nitrogen. The initiator solution is then slowly charged into the reactor and, after 10 minutes, the rest of the emulsion is continuously fed in using a metering pump at a rate of 0.5%/min. Once all the monomer emulsion is charged into the main reactor, the temperature is held at 76° C. for an additional 2 hours to complete the reaction. Full cooling is then applied and the reactor temperature is reduced to 35° C. The product is collected into a holding tank. After drying the latex, the onset Tg was 52.0° C.

Preparation of Latex C

A latex emulsion comprised of polymer particles generated from the emulsion polymerization of styrene, n-butyl acrylate and beta-CEA is prepared as follows. A surfactant solution consisting of 0.8 grams Dowfax 2A1 (anionic emulsifier) and 514 grams de-ionized water is prepared by mixing for 10 minutes in a stainless steel holding tank. The holding tank is then purged with nitrogen for 5 minutes before transferring into the reactor. The reactor is then continuously purged with nitrogen while being stirred at 300 RPM. The reactor is then heated up to 76° C. at a controlled rate, and held there. Separately 8.1 grams of ammonium persulfate initiator is dissolved in 45 grams of de-ionized water.

Separately the monomer emulsion is prepared in the following manner. 388.8 grams of styrene, 151.2 grams of butyl acrylate, 16.2 grams of β-CEA, 2.16 grams of 1-dodecanethiol, 1.89 grams of ADOD, 8.04 kg of Dowfax 2A1 (anionic surfactant), and 257 grams of deionized water are mixed to form an emulsion. 1% ofthe above emulsion is then slowly fed into the reactor containing the aqueous surfactant phase at 76° C. to form the "seeds" while being purged with nitrogen. The initiator solution is then slowly charged into the reactor and, after 10 minutes, the rest of the emulsion is continuously fed in using a metering pump at a rate of 0.5%/min. Once all the monomer emulsion is charged into the main reactor, the temperature is held at 76° C. for an additional 2 hours to complete the reaction. Full cooling is then applied and the reactor temperature is reduced to 35° C. The product is collected into a holding tank. After drying the latex, the molecular properties were Mw=83,219, Mn=24859 and the onset Tg was 51.1° C.

Comparative Example 1

793.3 grams of latex A having a solids loading of 41.4 weight % is added to 1529.5 grams of deionized water in a vessel and stirred using an IKA Ultra Turrax® T50 homogenizer operating at 4,000 rpm. Thereafter, 97.5 grams of cyan pigment dispersion PB 15:3 having a solids loading of 17 weight % is added to the above mixture followed by drop-wise addition of 48 grams of a flocculent mixture containing 4.8 grams polyaluminum chloride mixture and 43.2 grams 0.02 molar nitric acid solution. As the flocculent mixture is added drop-wise, the homogenizer speed is increased to 5,200 rpm and the mixture is homogenized for an additional 5 minutes. Thereafter, the mixture is heated at 1° C. per minute to a temperature of 52° C. and held there for a period of about 1.5 to about 2 hours resulting in a volume average particle diameter of 7.4 microns as measured with a Coulter Counter. During heat up period, the stirrer is run at about 250 rpm and, 10 minutes after the set temperature of 52° C. is reached, the stirrer speed is reduced to about 220 rpm.

Figure 1B:
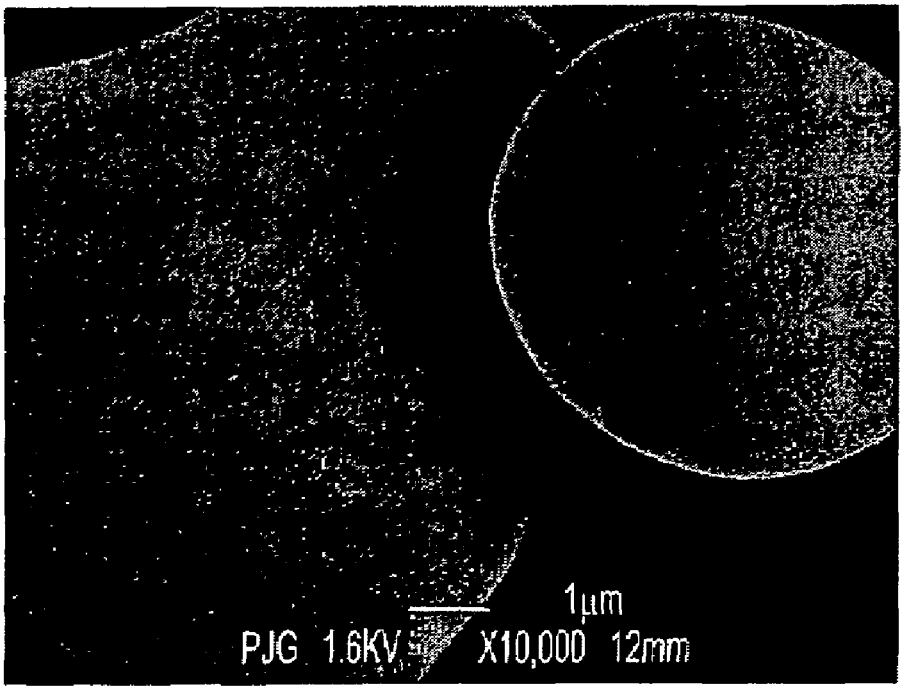

157.4 grams of latex C having a solids loading of 40.65% is added to the reactor mixture and allowed to aggregate for an additional period of about 30 minutes at 52° C. resulting in a volume average particle diameter of about 8.3 microns. Adjusting the reactor mixture pH to 7 with 1.0 M sodium hydroxide solution freezes the particle size. Thereafter, the reactor mixture is heated at 1° C. per minute to a temperature of 95° C., followed by adjusting the reactor mixture pH to 4.0 with 0.3 M nitric acid solution. Following this, the reactor mixture is gently stirred at 95° C. for 15 hours to enable the particles to coalesce and spherodize. The reactor heater is then turned off and the reactor mixture is allowed to cool to room temperature at a rate of 1° C. per minute. The resulting toner mixture is comprised of about 16.7 percent of toner, 0.25 percent of anionic surfactant and about 82.9 percent by weight of water. The toner of this mixture comprises about 96.2 percent styrene/acrylate polymer, and about 3.8 percent Cyan PB 15:3 pigment, and has a volume average particle diameter of about 8.5 microns and a GSD of about 1.21. The particles are washed 6 times, where the 1st wash is conducted at pH of 10 at 63° C., followed by 3 washes with deionized water at room temperature, one wash carried out at a pH of 4.0 at 40° C., and finally the last wash with deionized water at room temperature. The toner prepared is depicted in FIGS. 1A and 1B.

Example 1

Crosslinked Latex in Shell 793.3 grams of latex A having a solids loading of 41.4 weight % is added to 1529.5 grams of deionized water in a vessel and stirred using an IKA Ultra Turrax® T50 homogenizer operating at 4,000 rpm. Thereafter, 97.5 grams of cyan pigment dispersion PB 15:3 having a solids loading of 17 weight % is added to the above mixture followed by drop-wise addition of 48 grams of a flocculent mixture containing 4.8 grams polyaluminum chloride mixture and 43.2 grams 0.02 molar nitric acid solution. As the flocculent mixture is added drop-wise, the homogenizer speed is increased to 5,200 rpm and the mixture is homogenized for an additional 5 minutes. Thereafter, the mixture is heated at 1° C. per minute to a temperature of 52° C. and held there for a period of about 1.5 to about 2 hours resulting in a volume average particle diameter of 7.4 microns as measured with a Coulter Counter. During heat up period, the stirrer is run at about 250 rpm and, 10 minutes after the set temperature of 52° C. is reached, the stirrer speed is reduced to about 220 rpm.

128 grams of cross-linked latex B having a solids loading of 50% is added to the reactor mixture and allowed to aggregate for an additional period of about 30 minutes at 52° C. resulting in a volume average particle diameter of about 8.3 microns. Adjusting the reactor mixture pH to 7 with 1.0 M sodium hydroxide solution freezes the particle size. Thereafter, the reactor mixture is heated at 1° C. per minute to a temperature of 95° C., followed by adjusting the reactor mixture pH to 4.0 with 0.3 M nitric acid solution. Following this, the reactor mixture is gently stirred at 95° C. for 15 hours to enable the particles to coalesce and spherodize. The reactor heater is then turned off and the reactor mixture is allowed to cool to room temperature at a rate of 1° C. per minute. The resulting toner mixture is comprised of about 16.7 percent of toner, 0.25 percent of anionic surfactant and about 82.9 percent by weight of water. The toner of this mixture comprises about 80.2 percent styrene/acrylate polymer, about 16 percent of styrene/acrylate cross-linked polymer, about 3.8 percent of Cyan PB 15:3 pigment, and has a volume average particle diameter of about 8.3 microns and a GSD of about 1.19. The particles are washed 6 times, where the 1st wash is conducted at pH of 10 at 63° C., followed by 3 washes with deionized water at room temperature, one wash carried out at a pH of 4.0 at 40° C., and finally the last wash with deionized water at room temperature.

Figure 2A:
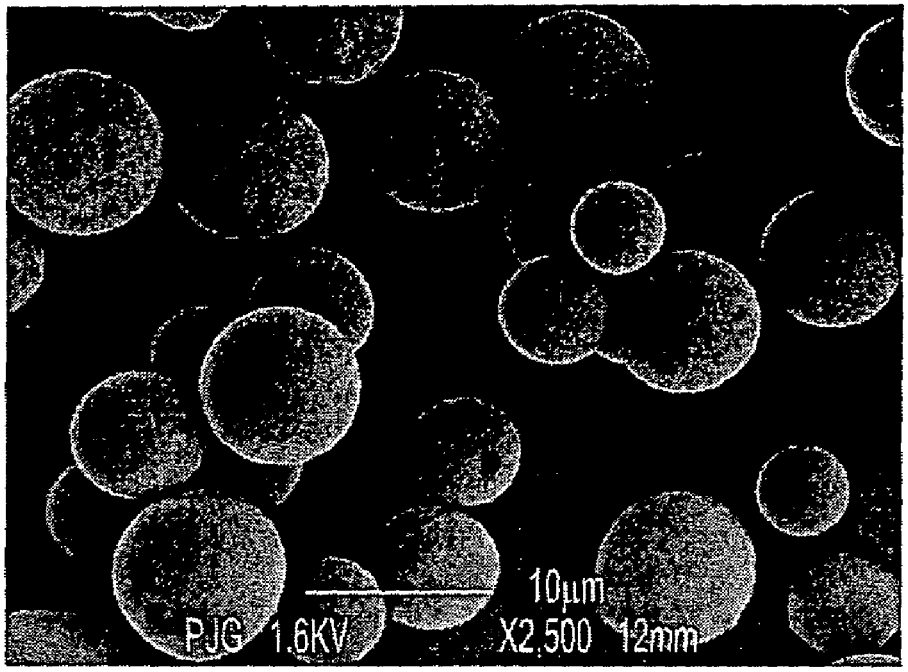
FIGS. 2A and 2B are scanning electron microscope images illustrating toner according to the present disclosure.
Figure 2B:
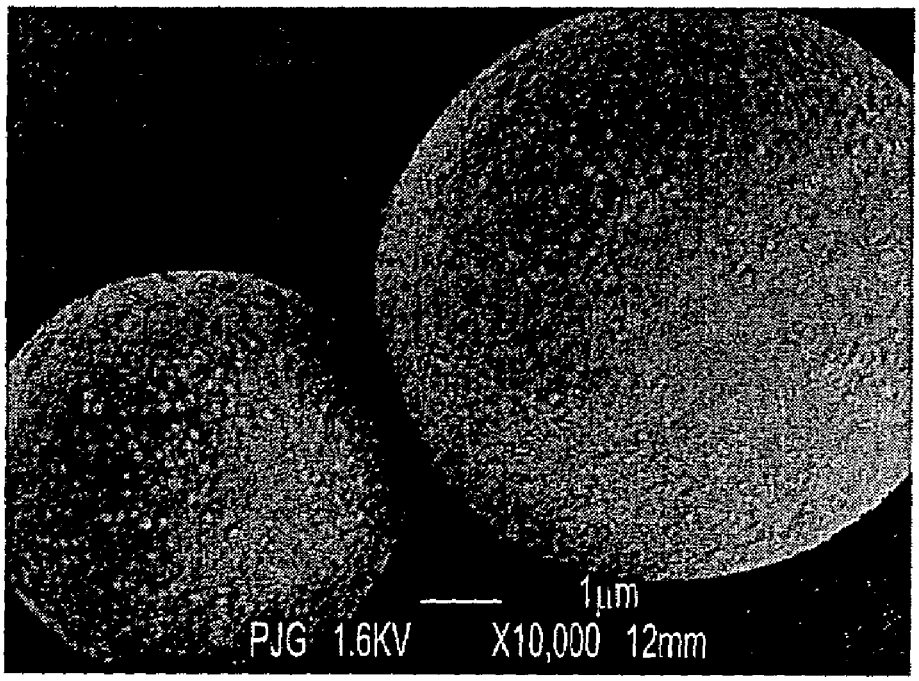

The toner prepared is depicted in FIGS. 2A and 2B. The toner depicted in the scanning microscope images of FIGS. 2A and 2B have small bumps caused by the addition of a cross-linked resin onto the surface of the toner aggregates, which forms the shell of the toner after coalescence. These cross-linked resin bumps act as spacers on the toner surface and can therefore replace external silica additives used to improve, for example, semiconductive magnetic brush development.

Developer Formation/Results

The toners of Example 1 and Comparative Example 1 are each blended with a set of additives including silica particles and titanium dioxide particles. Developers are prepared from the toners of Example 1 and Comparative Example 1 by mixing each toner with carrier comprising 65 micron steel core from Hoeganaes Corporation (New Jersey, USA) powder-coated with 1 wt. % poly(methyl-methacrylate) at a toner to carrier mass ratio of 4.5%.

Figure 3:
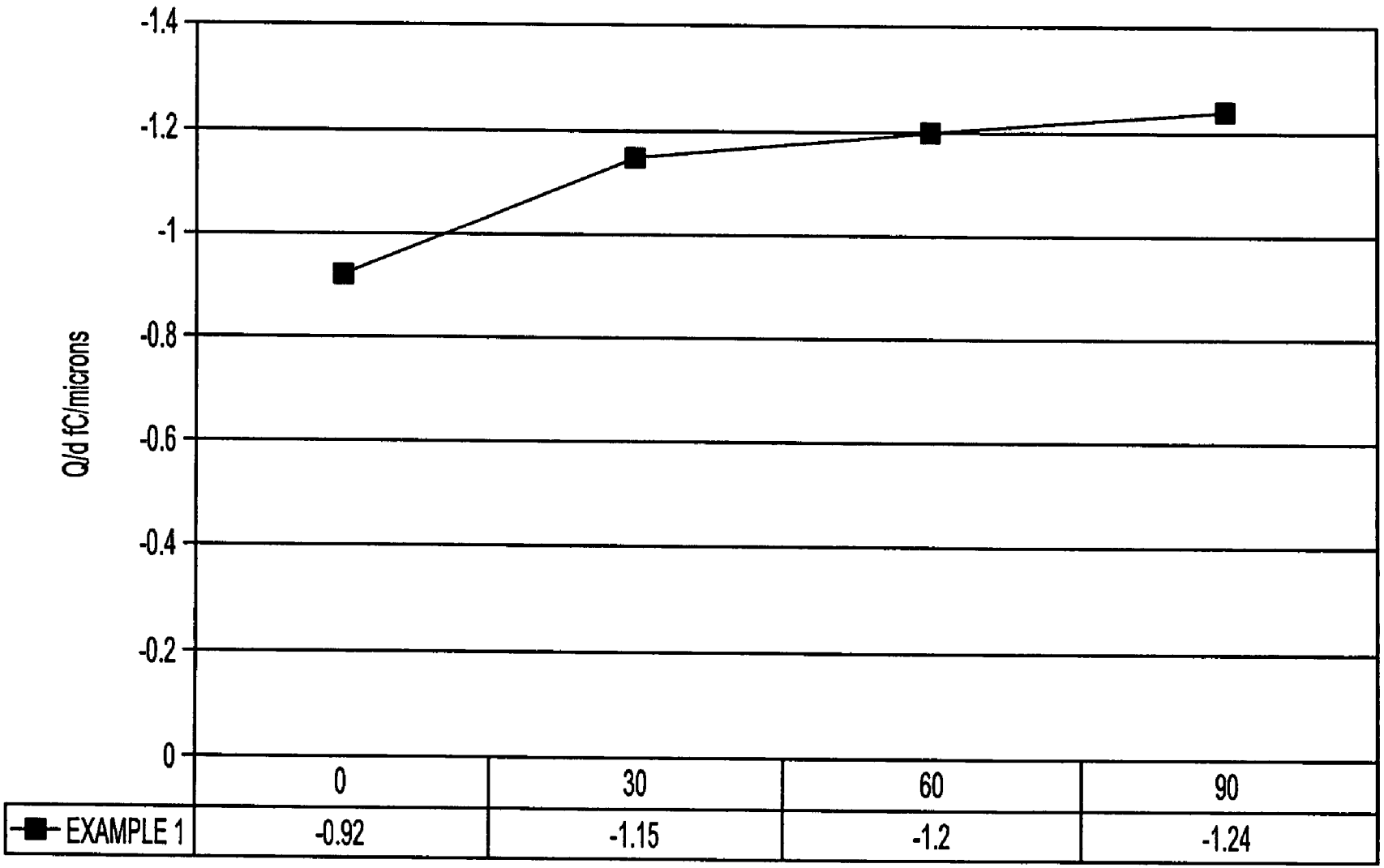
FIG. 3 is a chart depicting the evolution of toner q/d for a toner within the present disclosure.

The developer is then charged for 20 minutes. The charging experiments are conducted in B zone (i.e., at 23 degrees centigrade and 50% relative humidity) using a paint-shaker. FIG. 3 depicts the evolution of toner q/d (i.e., charge to size ratio as measured in a charge spectrograph) with toner aging by paint-shaking for up to 90 minutes.

Figure 4:
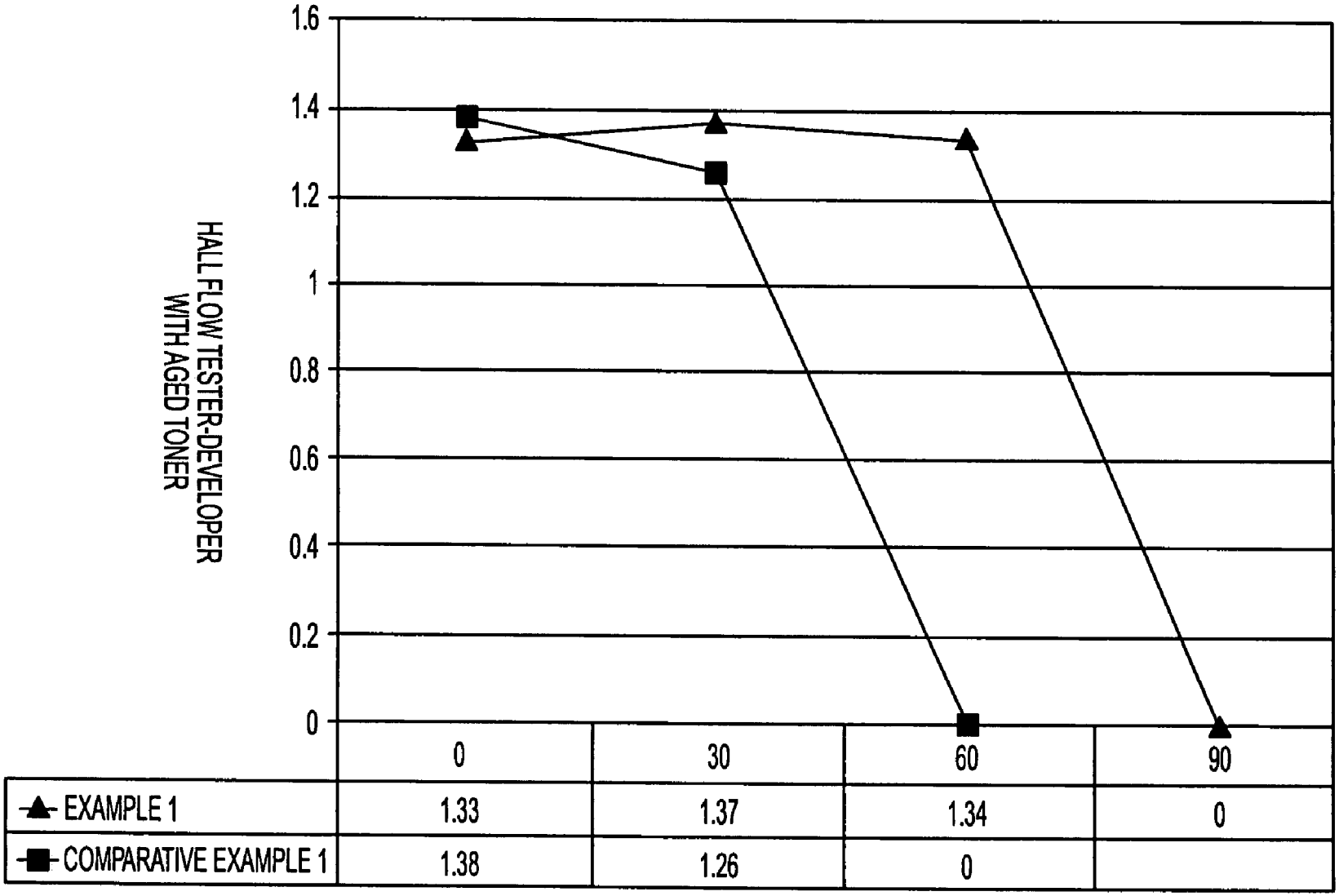
FIG. 4 is a chart depicting the results of a Hall flow test of a toner of the present disclosure, as compared to a toner that does not contain cross-linked polymer in the shell.

In addition, a standard Hall cell (ASTM B-213-76, -77) is conducted to measure developer flow. FIG. 4 shows the change in developer flow measured by this test. The developer made with the toner of Comparative Example 1 fails the developer flow test after 60 minutes of paint-shaking while the developer made with the toner of Example 1 remains free-flowing until 90 minutes of paint-shaking. The flow aging profiles in FIG. 4 indicate that the developer made with the toner of Example 1 retains its flow properties for a longer aging time than the developer made with the toner of Comparative Example 1.

Figure 5:
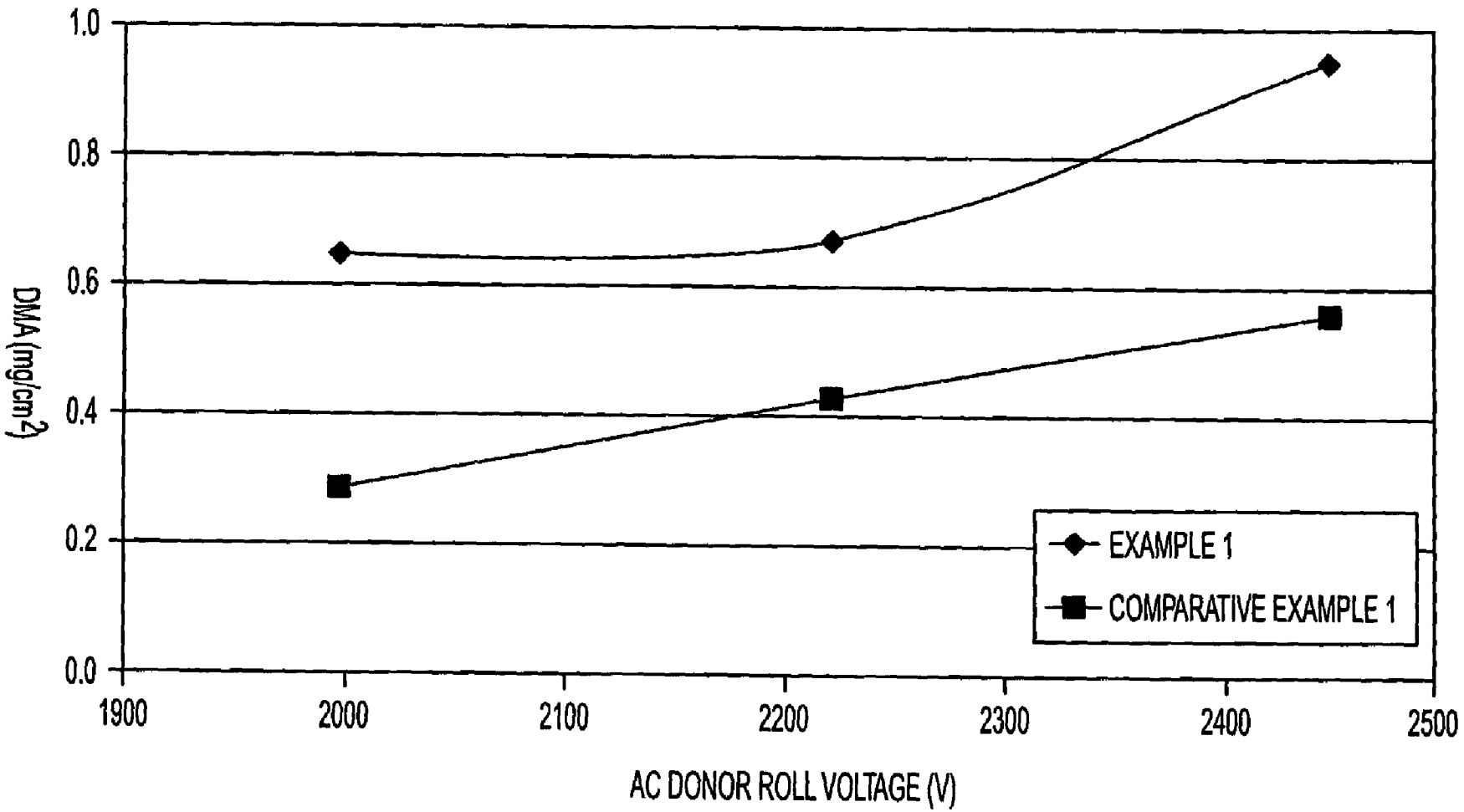
FIGS. 5 and 6 are charts depicting the developability of a toner of the present disclosure, as compared to a toner that does not contain cross-linked polymer in the shell.

Developed toner mass per area (DMA) of each developer is measured in a Xerox DC265 printer at a constant DC voltage between the donor roll and exposed photoreceptor of 350 V, and at varying AC voltage. DMA is measured by vacuuming a developed solid area toner patch of a known area off the photoreceptor and collecting the toner on a filter. FIG. 5 shows that the toner of Example 1 has substantially higher development than the toner of Comparative Example 1.

Figure 6:
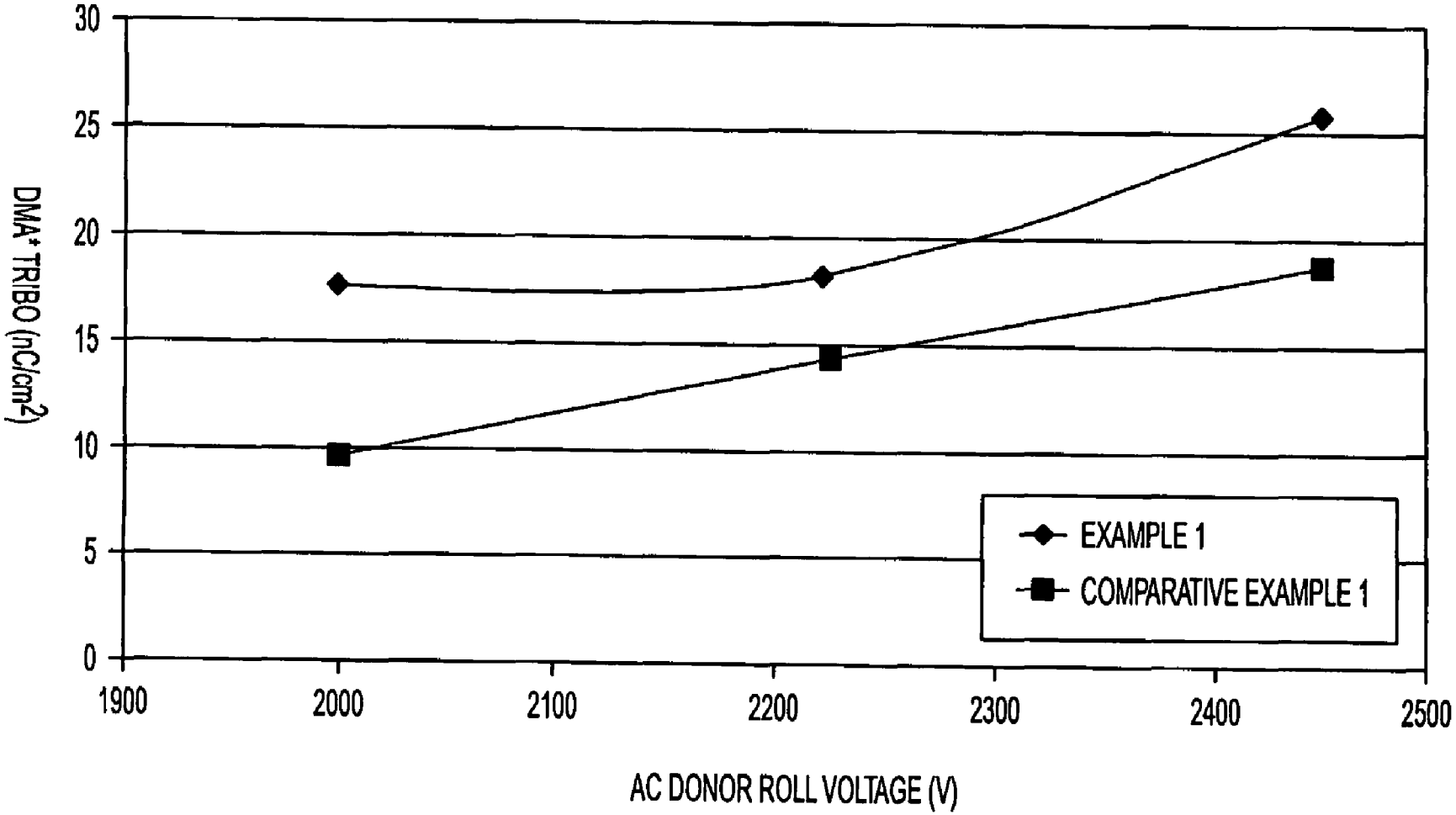

In order to verify whether the improvement in DMA with toner of Example 1 occurs due to reduced adhesion force between this toner and the donor roll, and to disentangle the effects of tribo on development, a normalized (DMA*Tribo) plot was constructed in FIG. 6. It is seen that normalized DMA is still higher with toner of Example 1, indicating a fundamental improvement in developability of this toner through its reduced adhesion to the donor roll.

Figure 7:
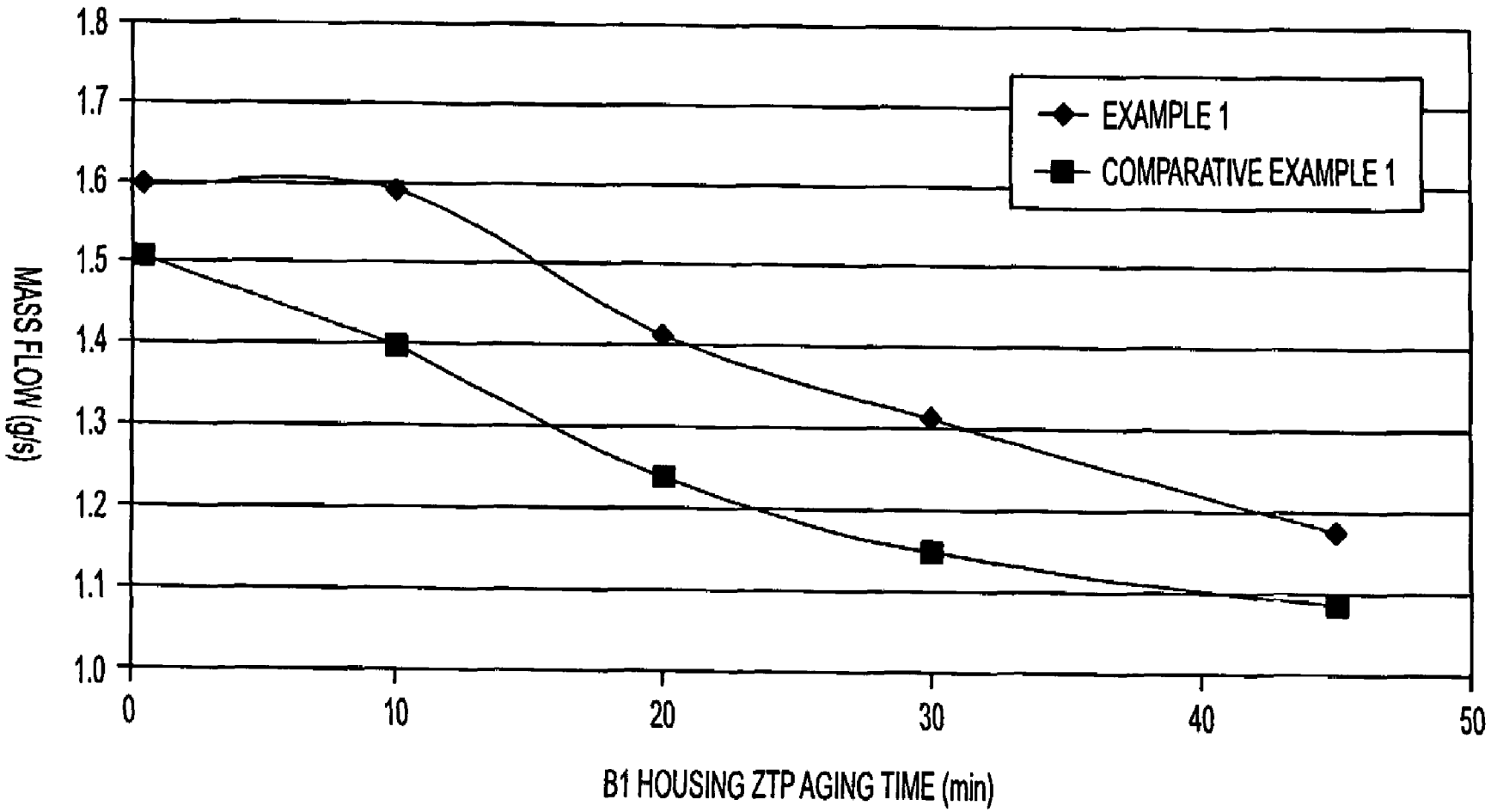
FIG. 7 is a chart depicting the developer mass flow as a function of zero throughput aging time for a toner of the present disclosure, as compared to a toner that does not contain cross-linked polymer in the shell.

Zero throughput (ZTP) aging is conducted in an offline-driven developer housing from a Xerox iGen3 printer, and developer mass flow is measured as a function of aging time using a standard Hall cell (ASTM B-213-76, -77). The change of mass flow with aging time is plotted in FIG. 7 as a function of aging time. It is seen that developer containing the toner or Example 1 has the highest mass flow over the course of this experiment—up to 45 minutes of ZTP aging due to its low cohesivity.

Figure 8:
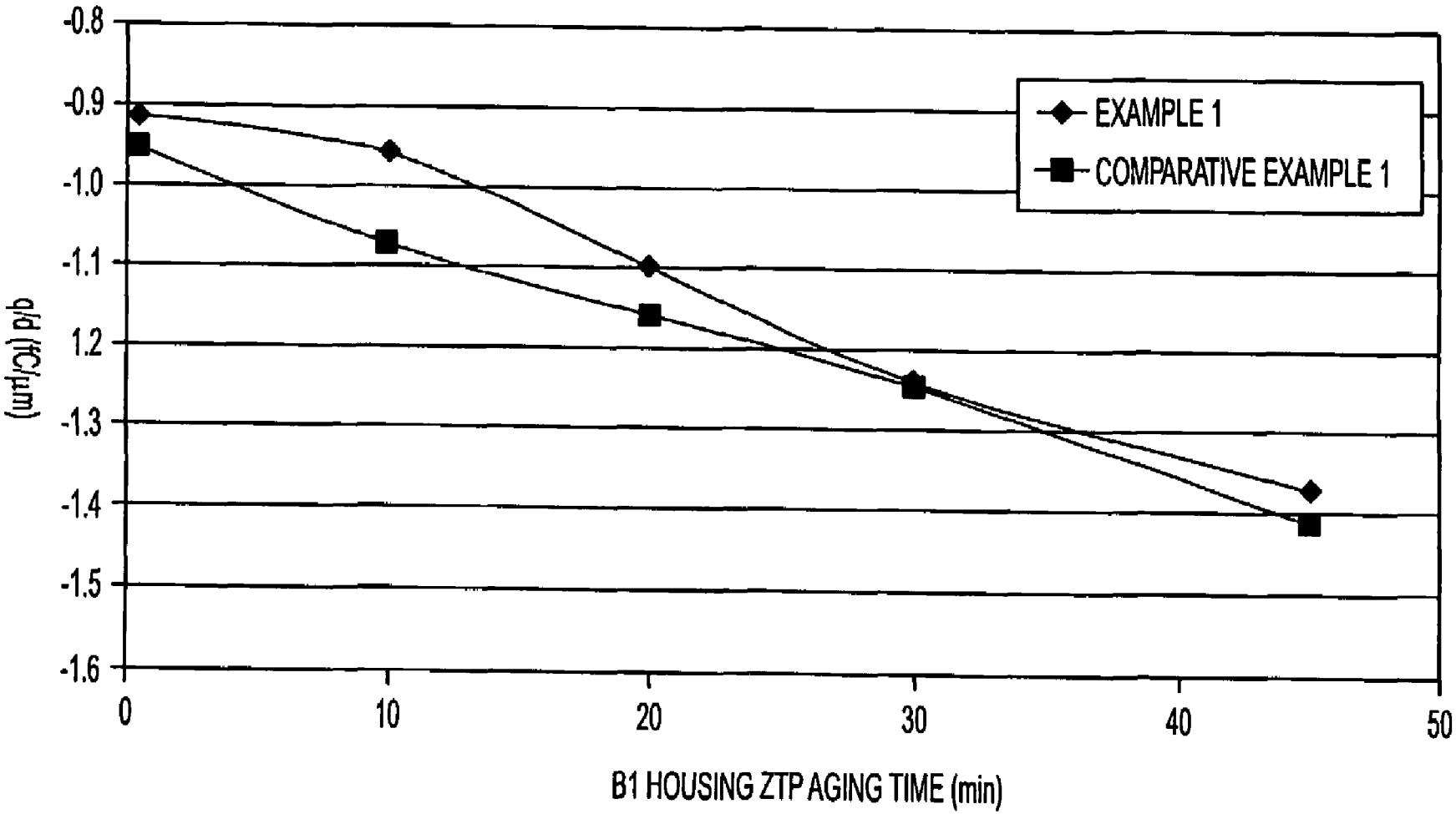
FIG. 8 is a chart depicting the q/d as a function of zero throughput aging time for a toner of the present disclosure, as compared to a toner that does not contain cross-linked polymer in the shell.

FIG. 8 shows the change of q/d (in femtocoulombs per micron) measured in a charge spectograph (CSG) with ZTP aging time. No charging abnormalities were observed due to the presence of cross-linked shell in the toner of Example 1. The charging profile of the toner of Example 1 in the B1 ZTP aging fixture repeats those of the toner of Comparative Example 1.

Figure 9:
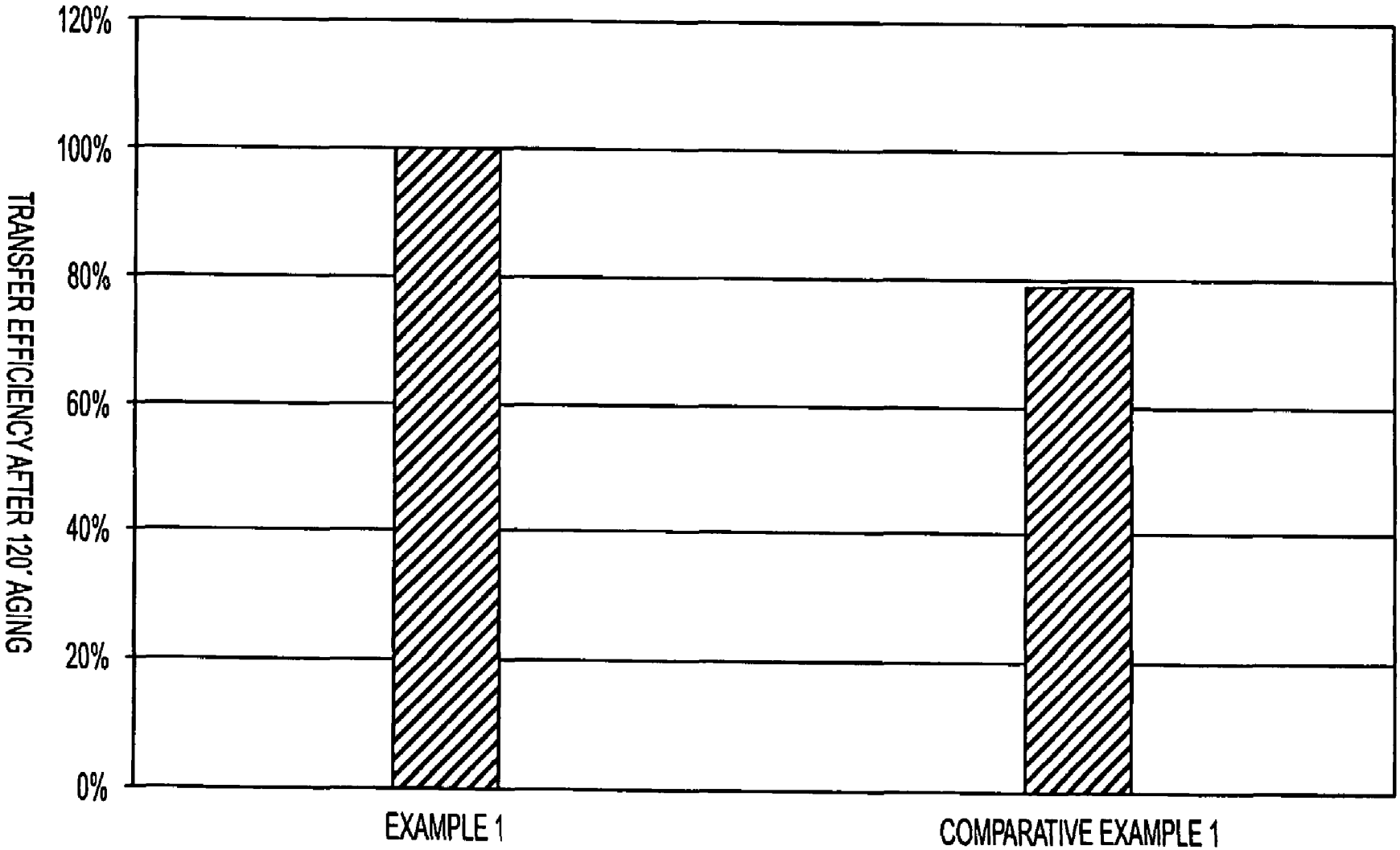
FIG. 9 is a chart depicting the transfer efficiency of a toner of the present disclosure, as compared to a toner that does not contain cross-linked polymer in the shell.

FIG. 9 shows the transfer efficiency of an aged developer in the hybrid scavengeless development housing after 120 minutes ZTP testing. The toner of Example 1 has higher transfer efficiency than the toner of Comparative Example 1.

It will be appreciated that various of the above-disclosed and other features and finctions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. An emulsion aggregation toner composition comprising toner particles having a core and a shell, the core comprising polymer and colorant and the shell comprising cross-linked polymer, wherein the shell is added substantially evenly to the surface of the core, said cross-linked polymer is incorporated only in the shell of the toner particles, the polymer of the core and the cross-linked polymer of the shell being composed of substantially the same polymer with the exception that the core polymer is not derived with a cross-linker, and incorporation of the cross-linked polymer in the shell provides bumps in the surface of the toner particles.

2. The toner composition according to claim 1, wherein said cross-linked polymer has a cross-linking density of from about 0.3 percent to about 50 percent.

3. The toner composition according to claim 1, wherein the cross-linked polymer is formed by emulsion polymerization.

4. The toner composition according to claim 3, wherein said cross-linked polymer is prepared by forming a monomer emulsion in which from about 0.4 to about 50 percent by weight of monomer in the emulsion is a cross-linker, and polymerizing the monomer to form the cross-linked polymer.

5. The toner composition according to claim 1, wherein said cross-linked polymer is cross-linked by at least one cross-linker selected from the group consisting of divinyl benzene, divinyl toluene, diacrylates and dimethacrylates.

6. The toner composition according to claim 1, wherein said cross-linked polymer comprises a cross-linked styrene acrylic copolymer.

7. The toner composition according to claim 6, wherein said copolymer is derived from styrene, n-butyl acrylate, 2-carboxyethyl acrylate and divinyl benzene.

8. The toner composition according to claim 1, wherein said polymer is derived from styrene, n-butyl acrylate and 2-carboxyethyl acrylate.

9. The toner composition according to claim 1, wherein the toner particles have a transfer efficiency of greater than 95% without including external spacer surface additives in the toner composition.

10. A method for forming toner, comprising:

(a) aggregating at least polymer particles and colorant particles to form core particles;

(b) aggregating at least cross-linked polymer particles to the surface of the core particles; and (c) coalescing the particles formed in (b) to form toner particles, wherein said cross-linked polymer is incorporated only in the shell of the toner particles, the shell is added substantially evenly to the surface of the core, the polymer of the core and the cross-linked polymer of the shell are composed of substantially the same polymer with the exception that the core polymer is not derived with a cross-linker, and the cross-linked polymer particles provide bumps in the surface of the toner particles.

11. The method according to claim 10, wherein the bumps have a diameter of from about 50 to about 300 nanometers and a height of from about 25 to about 150 nanometers.

12. The method according to claim 10, wherein said cross-linked polymer particles have a cross-linking density of from about 0.3 percent to about 50 percent.

13. The method according to claim 10, wherein the polymer particles are formed by emulsion polymerization.

14. The method according to claim 10, wherein the cross-linked polymer particles are formed by emulsion polymerization.

15. The method according to claim 14, wherein said cross-linked polymer particles are prepared by forming a monomer emulsion in which from about 0.4 to about 50 percent by weight of monomer in the emulsion is a cross-linker, and polymerizing the monomer to form the cross-linked polymer particles.

16. Developer comprising a toner composition according to claim 1 and carrier.

17. An emulsion aggregation toner composition comprising toner particles having a core and a shell, said core comprising polymer and colorant and the shell comprising cross-linked polymer, wherein the shell is added substantially evenly to the surface of the core, said cross-linked polymer is incorporated only in the shell of the toner particles, the polymer of the core and the cross-linked polymer of the shell are composed of substantially the same polymer with the exception that the core polymer is not derived with a cross-linker, incorporation of the cross-linked polymer in the shell provides bumps in the surface of the toner particles, and wherein the bumps have a diameter of from about 50 to about 300 nanometers and a height of from about 25 to about 150 nanometers.

18. The toner composition according to claim 1, wherein the core polymer is derived from at least styrene, butyl acrylate and β-carboxyethyl acrylate, and wherein the shell cross-linked polymer is derived from at least styrene, butyl acrylate, β-carboxyethyl acrylate and a cross-linker.

* * * * *